US005107180A

United States Patent [19]

Ormanns et al.

[11] Patent Number: 5,107,180

[45] Date of Patent: Apr. 21, 1992

[54] SYSTEM FOR OPERATING A PORTABLE LAMP

[75] Inventors: Siegfried Ormanns, Gelsenkirchen; Rainald Grevé, Bochum, both of Fed. Rep. of Germany

[73] Assignee: Ruhrkohle Aktiengesellschaft, Fed. Rep. of Germany

[21] Appl. No.: 607,904

[22] Filed: Nov. 1, 1990

[30] Foreign Application Priority Data

Nov. 4, 1989 [DE] Fed. Rep. of Germany ..... 3936809

[51] Int. Cl.[5] ..... H05B 37/00

[52] U.S. Cl. ..... 315/33; 315/76; 362/106

[58] Field of Search ..... 315/33, 55, 76, 94, 315/95, 291; 362/106

[56] References Cited

U.S. PATENT DOCUMENTS 4,225,906 9/1980 Gulliksen et al. ..... 362/106 X 4,399,492 8/1983 Kolesar ..... 362/106

*Primary Examiner*—David Mis

*Attorney, Agent, or Firm*—Blakely, Sokoloff, Taylor & Zafman

[57] ABSTRACT

Provided in a portable lamp is a cathode-heatable fluorescent bulb which is supplied from a rechargeable battery. For the purpose of charging, the lamp is coupled with a charging device situated in a region which is not at risk. The charging device is provided with separate connections for the charging voltage and for the application of a heating and starting voltage. At the beginning of the recharging phase, the battery current supply circuit for the bulb is interrupted. When removing the lamp the battery current supply circuit is closed, a heating voltage made available from the charging device and applied to the cathode of the bulb. Thereafter, the starting voltage is developed in a starting device and applied to the bulb electrodes. Only after striking of the bulb is the lamp electrically decoupled from the charging device. Starting with preheating is thus effected by means of the charging device. The lamp includes an incandescent bulb with a separate reflector.

24 Claims, 2 Drawing Sheets

SYSTEM FOR OPERATING A PORTABLE LAMP

BACKGROUND OF THE INVENTION

1. Field of the invention

The invention relates to a system for operating a portable lamp in spaces at risk of an explosion, particularly underground. The invention is directed also to a portable lamp, particularly a miner's cap lamp, and a charging device for charging the rechargeable battery carried with the lamp.

2) Prior Art

Cap lamps suitable for use underground in coalmines are generally operated with incandescent bulbs. The rechargeable battery or battery arrangement supplies the bulb, in use, with a voltage which is safe at the currents which flow through the bulb.

It is known that low pressure gas discharge bulbs, referred to hereinafter briefly as fluorescent bulbs, have a substantially higher light output than incandescent bulbs. They also have a service life many times higher than incandescent bulbs. In this respect, it would be desirable to use fluorescent bulbs instead of the conventional incandescent bulbs in cap lamps. This desirable feature has previously failed due to the problems connected with the switching on of fluorescent bulbs.

Fluorescent bulbs can a) be started cold by the application of a high starting voltage or b) be (softly) started after preheating of the cathodes with a substantially lower starting voltage.

Switching on without preheating (cold start) substantially reduces the service life of fluorescent bulbs. The average service life of a cold-started fluorescent bulb is only about one-eighth of a preheated bulb. The preheating of the cathode is however not possible in areas at risk of an explosion because destruction of the bulb or tube during the heating phase can ignite gases and/or dust and initiate gas explosions.

SUMMARY OF THE INVENTION

It is the object of the invention to make use of the aforementioned advantages of a fluorescent bulb, i.e. high light output and service life, in portable lamps for areas at risk of explosion.

The invention provides a system for operating a portable lamp in spaces at risk of explosion including at least one light source which is a cathode-heatable low pressure gas discharge bulb, a rechargeable battery for supplying current to the gas discharge bulb and a charging device which is disposed outside the space at risk of explosion and to which the portable lamp may be coupled for recharging the battery, whereby associated with the charging device are a heating voltage supply and a starting voltage device which may be selectively connected to the bulb by means of a coupling apparatus. The method used in operation of the system in accordance with the invention includes the following steps: extinguishing the gas discharge bulb serving as the light source at the beginning of a recharging phase at the charging device, providing a heating voltage from the charging device and applying the heating voltage to the cathode of the gas discharge bulb at the end of the recharging phase, connecting the gas discharge bulb to a current circuit which is supplied by the battery and developing a starting voltage, applying the starting voltage to the bulb electrodes and starting the gas discharge bulb before the lamp is electrically decoupled from the charging device.

The invention provides the prerequisites for the advantageous use of fluorescent bulbs as a light source in portable lamps for regions at risk of explosion. The high light yield with a low energy consumption enables the current to be supplied with relatively small and correspondingly light batteries. This weight and space saving is particularly advantageous with portable lamps. Since the cathodes are preheated, a high service life of the fluorescent bulb and thus low operational costs are ensured.

The preheating and starting are performed outside the regions at risk of explosion, preferably in special lamp spaces in which a plurality of connections for charging, preheating and starting a corresponding number of lamps are available. Before the beginning of the recharging process the bulb operating current circuit is preferably interrupted by means of a switching device which is connected to the charging current circuit and may be activated by the charging voltage. This feature ensures that the bulb is only switched on during its operational use but is switched off during the charging phase. This contributes to the increase of the service life of the bulb.

In order to be able reliably to start the bulb whilst preheating it, it is provided in a further embodiment of the invention that the interruption of the charging voltage, the application of the heating voltage and the application of the starting voltage are effected in synchronism and in a fixed phase relationship with the decoupling process on removal of the lamp from the discharging station.

In a preferred embodiment the lamp is supplied with power from the charging or heating or starting current circuits of the charging device via separate lamp connections and two switching devices. The first switching device is responsible for the coupling of the lamp or the associated battery to the charging current circuit and the second switching device, which is preferably in a predetermined switching phase relationship to the first switching device, serves automatically to connect the bulb electrodes to the heating or starting current circuits in the charging station.

Under certain circumstances it is advantageous to incorporate an additional cold starting system in the lamp. For this purpose a starting voltage generator, which is connected with the bulb electrodes and is manually actuable by means of a switch, is incorporated in the lamp. With the aid of this starting voltage generator, the fluorescent bulb can be switched on without preheating. The use of this cold starting system does, however, impair the service life of the lamp and is therefore only appropriate in the event that a second light source is not available in the lamp.

In a preferred embodiment of the invention an auxiliary light source in the form of an incandescent bulb is, however, connected in parallel to the battery current circuit. The incandescent bulb branch circuit can be interrupted during normal operation of the fluorescent bulb. For the purpose of switching on, a subsidiary current tripping device is incorporated in the operating current circuit of the fluorescent bulb and so constructed that it connects the incandescent bulb branch circuit to the battery when the current falls below a threshold value—optionally with a time delay. The incandescent bulb is thus automatically switched on (emergency light) when the fluorescent bulb firing space is interrupted, caused, for instance, by violent vibrations.

The fluorescent bulb has a relatively large light surface and thus operates with a flat reflector. Focussing is possible at best in the near distance. In accordance with the invention, a separate, sharply curved reflector is associated with the incandescent bulb, which forms a practically point light source, whereby the incandescent bulb may effectively be focussed also in the far distance. The latter is effected by a relative movement of the reflector and incandescent bulb or by use of a two-filament incandescent bulb.

The arrangement can be such that the incandescent bulb may be operated in addition to the fluorescent bulb, that is to say by means of a bypass which bypasses the auxiliary current tripping device. Suitable switching means are responsible for the operation of the incandescent bulb, inter alia for switching it off notwithstanding activation of the subsidiary current tripping device.

The two reflectors are preferably arranged in a common tubular housing at the opposed ends thereof. The housing is rotated, if required.

Further features and convenient exemplary embodiments of the invention are characterised in the dependent claims.

BRIEF DESCRIPTION OF THE DRAWINGS

The invention will be described below in more detail with reference to an exemplary embodiment illustrated in the drawings, in which.

DETAILED DESCRIPTION OF THE INVENTION

Figure 1:
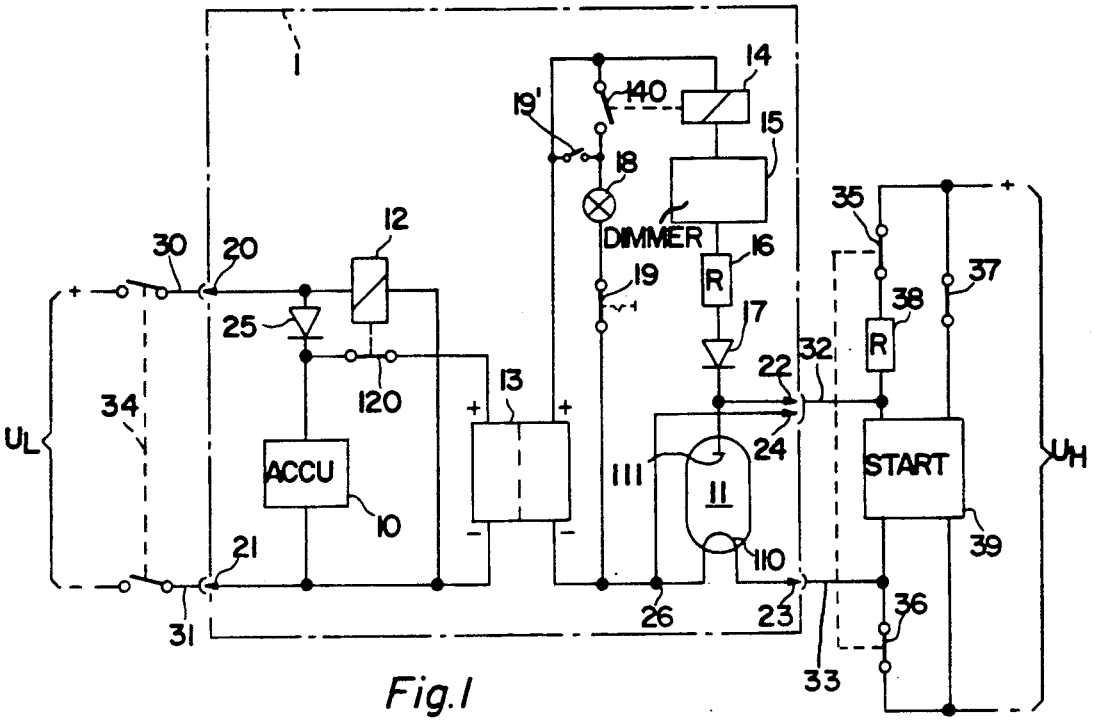
FIG. 1 shows an exemplary embodiment of a battery-operated lamp arrangement associated with the connections of a charging station.

The electrical components of a portable mine lamp are shown in FIG. 1 in a chain-dotted block 1 in association with the connections of a specially constructed battery charging device.

The portable cap lamp 1 has an accumulator arrangement 10, hereinafter referred to as a (rechargeable) battery, which serves to supply current to a light source constructed as a low pressure gas discharge bulb (fluorescent bulb) 11. Situated in the battery current circuit are opening contacts 120 operable by a switching device 12 and a direct current converter 13 which converts the battery voltage of, for instance, 2.4 or 3.6 V to the voltage of, for instance, 24 to 30 V required by the fluorescent bulb 11 as its operating voltage. The direct current converter can of course be omitted if the battery voltage corresponds to the bulb voltage.

In the operating current circuit of the fluorescent bulb 11 there are, in the illustrated exemplary embodiment, an auxiliary current tripping device 14, which actuates closing contacts 140 when the current falls below a predetermined threshold value—preferably with a time delay, a dimmer 15, a series resistor 16 and a decoupling diode 17. Arranged in a branch line parallel to the auxiliary current controller 14 and the fluorescent bulb 11 there is an incandescent lamp 18 which serves as an auxiliary light source and which after interruption of the main branch by the lamp 11 is automatically connected by the closing contacts 140 to the battery supply voltage (converter 13) and serves as an emergency light source. Manually operable contacts 19 enable the emergency light source 18 to be selectively switched off. A further manually operable switch 19' serves selectively to operate the incandescent bulb 18 in addition to the fluorescent bulb 11 by bypassing the closing contacts 140, see FIG. 3. Instead of the switch 19', a closed bypass can be provided, whereby the function of the switch 19' is taken over by the opening contacts 19.

The coupling of the cap lamp 1 with the charging device is effected in the described exemplary embodiment by a rotary coupling which is not shown in the drawing and by means of which on the one hand a mechanical mounting of the lamp 1 on the charging device is effected and on the other hand an electrical coupling of the lamp connections 20, 21; 22, 23 and 24 with associated connections 30, 31, 32 and 33 of the charging device is effected. As a result of this mechanical-electrical coupling it is possible to bring the charging, heating and starting current circuits, which will be described in more detail below, into a predetermined switching phase relationship at the beginning of charging and on removal of the cap lamp. The charging voltage $U_L$ is connected to the battery charging circuit by means of a preferably selectively actuable switch 34 with two switching contacts, constructed as closing contacts, via pairs of connections 30, 20 and 31, 21. When acted on by $U_L$, the switching device 12 is activated and interrupts the bulb operating current circuit by means of the opening contacts 120. The battery 10 is thereafter charged with the charging voltage $U_L$ by way of a decoupling diode 25. The bulb 11 is extinguished.

The circuit of the lamp 1 is coupled to the heating and starting current circuits in the charging device by way of the connections 22, 23 and 24 and the complementary connections 32, 33. During the charging phase of the battery 10, the switches constructed as opening contacts or switching contacts 35, 36 and 37 are opened so that the connections 32 and 33 and the complementary connections of the lamp 1 are dead. When removing the lamp 1, i.e. at the end of the charging phase in the charging device, the switch 34 is firstly opened; the switching device 12 shown as a relay is de-energised and the switch contact 120 closes the battery current circuit via the converter 13. Simultaneously or directly thereafter, the switch contacts 35, 36 close the heating current circuit which extends from the positive terminal of the heating voltage source $U_H$ via the switch contact 35, a series resistor 38, the connection 32 constructed as a contact bridge, the lamp-side connection 24, the connection point 26 to the cathode 110 to be heated, the connection 23, the complimentary connection 33 on the device side and the switch contact 36 to the negative pole of the heating voltage $U_H$. After a suitable preheating phase, the switch or switch contact 37 also closes and triggers a starting device 39. The starting device 39 applies a suitable starting voltage to the anode 111 of the fluorescent bulb 11 via a contact bridge on the connection 32 with the consequence that the bulb 11 strikes. The operating voltage, supplied from the battery 10, is applied across the preheated cathode 110 and the anode 111 so that the bulb remains switched on if in the last phase of the mechanical decoupling of the lamp 1 the electrical separation from the charging device also occurs.

The heating voltage $U_H$ can differ from the charging voltage $U_L$; it can however be the same as it. In this case the connection terminals and $U_L$ and $U_H$ are switched together.

A starter individual to the lamp, which may be provided, for cold starting the bulb 11 should be incorporated between the connections 22 and 23.

Figure 2:
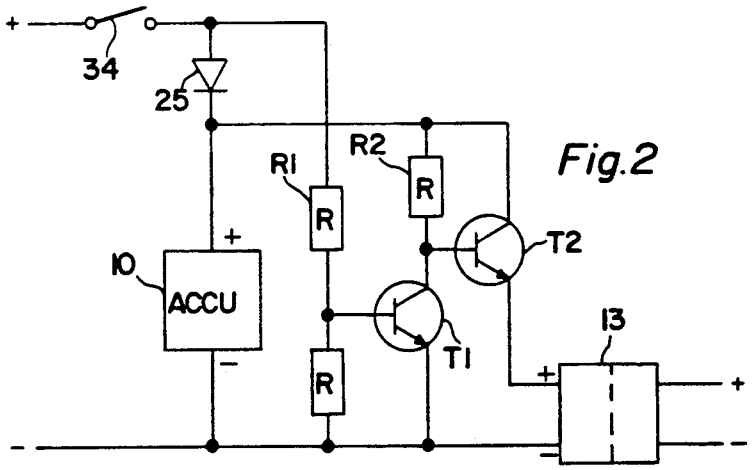
FIG. 2 shows an embodiment of a switching device which is connected to the charging circuit of the arrangement of FIG. 1 and switches the bulb operating current circuit.

An electronic switching device to replace the relay arrangement 12, 120 of FIG. 1 is shown in FIG. 2. This electronic switching device has two transistors T1 and T2, of which T2 fulfills the function of the opening contacts 120. T1 is closed during battery operation and the base of the transistor T2 is at a relatively high potential above the resistor R2 and makes the collector-emitter section of T1 conductive. The decoupling diode 25 prevents current flow from the positive pole of the battery via the resistor R1 to the base of T1. The switch 34 is closed during the battery charging phase; the battery 10 is charged via the diode 25. The potential of the base of the transistor T1 is increased via R1 whereby T1 becomes conductive and pulls the base of T2 to a negative potential. The consequence is a blocking of T2, i.e. the interruption of the supply current circuit of the bulb 11 in FIG. 1.

Figure 3:
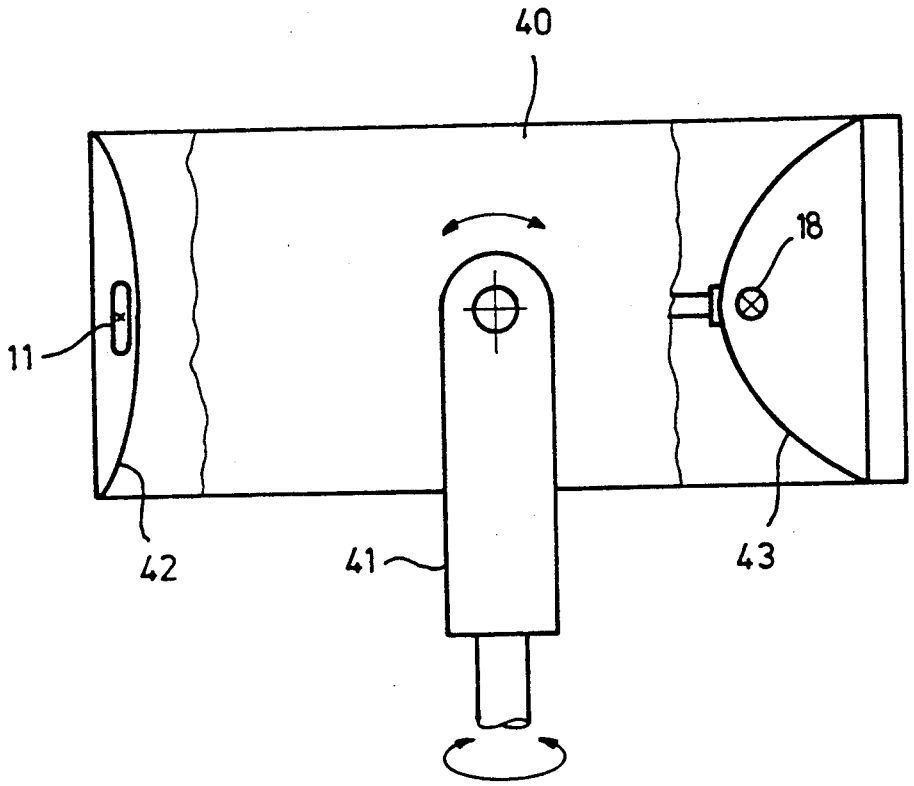
FIG. 3 is a partly sectioned side elevation of a reversible lamp in accordance with the invention.

FIG. 3 shows a reversible lamp which can also be constructed as a cap lamp or as a lamp which is portable in some other manner. The reversible lamp has a housing 40 which is mounted in a bifurcation 41 so as to be pivotable about a horizontal axis extending perpendicular to the plane of the drawings. The bifurcation 41 is pivotally mounted or securable in a reversible orientation on a miner's helmet.

The housing 40 is of tubular construction and carries the fluorescent bulb 11 at its one end and the incandescent bulb 18 at its opposite end. Associated with the fluorescent bulb 11 is a relatively flat reflector 42 whilst the incandescent bulb 18 is disposed in a sharply curved reflector 43. The latter is displaceable for the purpose of focussing in the axial direction. Numerous modifications are possible within the scope of the inventive concept. Thus instead of the described coupling between the mechnical and electrical connector components of the lamp and charging device a selective actuation of the switching sequence of the charging, heating and/or starting current circuits can be provided. The switching phases can also be made adjustable with the aid of a suitable switching device and be actuable either automatically or selectively. Of importance is the integration of all the electrical components necessary for so-called soft starting of a fluorescent bulb into the charging device or their association with the charging device so that the fluorescent bulb is reliably started and switched on when the lamp is removed from the charging device. The auxiliary current controller 14 should preferably be effective only with a time delay so as to prevent the auxiliary current circuit being closed by the incandescent bulb 18 before the striking of the fluorescent bulb 11. The dimmer serves to adjust the lighting current. It can of course be omitted. A suitable series resistor can in practice be connected into the auxiliary current branch circuit to the incandescent bulb 18 to match the auxiliary bulb operating voltage to the voltage at the output of the converter 13. The configuration and time sequence of the switch or switch contacts 35, 36 or 37 for actuating the heating and starting current circuits can be modified in numerous ways. The switching arrangement illustrated in FIG. 1 is thus only to be regarded as one possible alternative for carrying out the method in accordance with the invention.

The reversible lamp of FIG. 3 can further be so constructed that the housing has a single light outlet opening, whereby the two light sources are movable or pivotable with their reflectors, when required, in front of this opening.

The outer shape of the housing can alter accordingly. The incandescent bulb 18 can be movable instead of the reflector 43 or in addition to it for the purpose of focussing. It is also possible to use a two-filament incandescent bulb. Finally, there is also the possibility of making the fluorescent bulb 11 focussable, albeit to a limited extent. Furthermore the incandescent bulb and the fluorescent bulb can also operate together with a common reflector.

We claim:

1. In a system for operating a portable lamp in spaces at risk of explosion, said system having a heated-cathode low pressure gas discharge bulb as a light source, at least one rechargeable battery carried with the portable lamp and a charging device suitable for coupling to and charging the battery, said charging device being arranged externally of the space at risk of explosion, a method including the following steps:

a) extinguishing the gas discharge bulb serving as the light source at the beginning of a recharging phase at the charging device;

b) providing a heating voltage from the charging device and applying the heating voltage to the cathode of the gas discharge bulb at the end of the recharging phase;

c) connecting the gas discharge bulb to a current supply circuit which is fed by the battery;

d) developing a starting voltage, applying the starting voltage to the bulb electrodes and starting the gas discharge bulb before the lamp is electrically decoupled from said charging device.

2. Method as claimed in claim 1, characterized in that the current supply circuit of the gas discharge bulb is interrupted before beginning the recharging.

3. Method as claimed in claim 2, characterized in that the application of the heating voltage to the cathode occurs after the connection to the current supply circuit.

4. Method as claimed in claim 1, characterized in that an interruption of the charging voltage, the application of the heating voltage and the application of the starting voltage occurs synchronously and in a fixed phase relationship with a mechanical decoupling process between the lamp and charging device.

5. Method as claimed in claim 1, characterized in that the heating voltage is derived from the charging voltage of the charging device.

6. Method as claimed in claim 1, characterized in that the current flowing in the current supply circuit of the bulb after starting thereof is monitored and after the current falls below a threshold value a parallel current circuit including an incandescent lamp is closed which parallel current circuit is supplied by the battery.

7. Method as claimed in claim 6, characterized in that the parallel current circuit containing the incandescent bulb is closed with a time delay after the current has fallen below the threshold value.

8. System for operating a portable lamp in spaces at risk of explosion, including at least one light source which is a heated cathode low pressure gas discharge bulb, a rechargeable battery for supplying current to the gas discharge bulb, and a charging device which is arranged externally of the space at risk of explosion and to which the portable lamp may be coupled for recharging the battery, wherein a heating voltage supply and a starting voltage device, which are selectively connectable to the lamp via a coupling apparatus, are associated with the charging device.

9. System as claimed in claim 8, characterized in that a first switching device, which interrupts the lamp current supply circuit, is connected to the charging current circuit and may be activated by the charging current.

10. System as claimed in claim 9, characterized in that lamp connections for coupling the heating and starting voltages to the lamp electrodes are provided separately from the battery charging connections.

11. System as claimed in claim 10, characterized in that a second switching device with separate switches is incorporated in the heating and starting current circuits and so constructed that the starting current circuit may be activated out of phase after the heating current circuit.

12. System as claimed in claim 11, characterized in that the first and second switching devices are coupled together and are in a predetermined switching phase relationship.

13. System as claimed in claim 11, characterized in that at least one of the switching devices is mechanically coupled with the coupling apparatus.

14. System as claimed in claim 13, characterized in that the coupling apparatus is constructed as a rotary coupling and that at least two switches or switch contacts are actuable in different rotary positions of the coupling.

15. System as claimed in claim 8, characterized in that an auxiliary current tripping device is incorporated in the operating current circuit of the gas discharge bulb and so constructed that it connects a current circuit including an incandescent lamp to the battery when the current falls below a threshold value.

16. System as claimed in claim 15, characterized in that manually operable contacts are arranged in series with the incandescent lamp and that the auxiliary current tripping device becomes effective with a predetermined time delay after falling below the threshold value.

17. System as claimed in claim 9, characterized in that means are provided for electrically decoupling the first switching device from the battery current circuit.

18. System as claimed in claim 17, characterized in that the decoupling means is a diode.

19. System as claimed in claim 8, characterized in that means are provided for electrically decoupling the heating and starting current circuit from the battery current circuit.

20. Arrangement as claimed in claim 19, characterized in that the decoupling means is a diode.

21. Arrangement as claimed in claim 8, characterized in that a dimmer is connected in the current supply circuit of the gas discharge bulb.

22. System for operating a portable lamp in spaces at risk of explosion, including a first light source in the form of a heated-cathode low pressure gas discharge bulb with which a first reflector is associated, a second, focussable light source in the form of an incandescent lamp with which a second reflector is associated, a rechargeable battery for supplying current to the light sources, and a charging device which is arranged externally of the space at risk of explosion and to which the portable lamp may be coupled for recharging the battery, wherein a heating voltage supply and a starting voltage device, which are selectively connectable to the bulb via a coupling device, are associated with the charging device.

23. Charging device including a charging voltage device for charging a battery of at least one portable lamp with a bulb, a heating voltage device, and a starting voltage device, wherein the heating voltage device and the starting voltage device are selectively connectable to the lamp by a coupling apparatus.

24. Charging device as claimed in claim 23, further comprising, separate switches arranged in said heating and starting voltage devices respectively, said switches configured such that at the end of a charging process, a switch interrupts the charging voltage device so that a battery current circuit in the portable lamp is closed and, simultaneously therewith at the earliest, but after the heating voltage device is activated, the starting voltage device is activatable.

* * * * *